United States Patent [19]

Atherton

[11] 4,187,046

[45] Feb. 5, 1980

[54] POWER TOOL

[76] Inventor: Henry Atherton, 1536 Vine St., #201, Denver, Colo. 80206

[21] Appl. No.: 865,745

[22] Filed: Dec. 29, 1977

[51] Int. Cl.[2] ..... B27C 5/10

[52] U.S. Cl. ..... 409/180; 144/134 D; 409/181

[58] Field of Search ..... 144/134 R, 134 D, 136 R, 144/136 C, 323; 90/12 D

[56] References Cited

U.S. PATENT DOCUMENTS

| | | | |
|---|---|---|---|
| 1,566,824 | 12/1925 | Carter | 144/134 D |
| 2,623,557 | 12/1952 | Kendall | 144/134 D |
| 2,672,898 | 3/1954 | Schuster | 144/136 C |
| 2,771,104 | 11/1956 | Saxe | 144/134 D X |
| 2,935,102 | 5/1960 | Potter | 144/134 D |
| 2,997,081 | 8/1961 | Christophersen | 144/134 D |
| 3,009,493 | 11/1961 | Dodegge | 144/134 D |
| 3,212,541 | 10/1965 | Burrows et al. | 144/134 D |
| 3,454,061 | 7/1969 | Cordone et al. | 144/134 D |
| 3,494,394 | 2/1970 | Stock | 144/134 D |
| 3,494,395 | 2/1970 | Graham | 144/136 C |
| 3,893,372 | 7/1975 | Strakeljahn | 144/134 D |
| 3,893,372 | 7/1975 | Strakeljahn | 144/134 D |
| 4,024,898 | 5/1977 | Bergler et al. | 144/134 D |
| 4,044,805 | 8/1977 | Gronholz | 144/136 C |

FOREIGN PATENT DOCUMENTS

| | | | |
|---|---|---|---|
| 1240648 | 5/1967 | Fed. Rep. of Germany | 144/134 D |
| 2261105 | 9/1975 | France | 144/144 R |
| 998320 | 7/1965 | United Kingdom | 144/134 D |

*Primary Examiner*—Robert L. Spruill
*Assistant Examiner*—W. D. Bray
*Attorney, Agent, or Firm*—Ancel W. Lewis, Jr.

[57] ABSTRACT

A hand operated power tool is used for trimming and edge finishing a workpiece such as a counter top or desk top. The tool comprises a housing having two guide surfaces arranged substantially perpendicular to each other and an electric motor-driven cutter mounted in a recess in one of the guide surfaces, arranged parallel to one guide surface and perpendicular to the other guide surface. The two guide surfaces support the tool on a flat surface of the workpiece and maintain the cutter in position with respect to the material to be cut. In addition, a cutter guide bearing at the end of the cutter further guides and limits the movement of the cutter. The tool may be operated in two different positions so that edges adjacent to blind corners and curved surfaces may be trimmed. Different shaped cutter bits can be used for trimming square, beveled, or radiused edges with no adjustments to the tool.

18 Claims, 9 Drawing Figures

POWER TOOL

FIELD OF THE INVENTION

The present invention generally relates to power tools and more particularly to hand operated power tools in the nature of routers or laminate cutters.

BACKGROUND OF THE INVENTION

Routers or laminate cutters are widely used in woodworking operations and in the fabrication of furniture and other articles. In the fabrication of counter tops and desk tops, for instance, exposed surfaces are often finished by applying laminated platic sheets to the surfaces, and it is often necessary to perform a finishing operation by trimming or routing the edge line formed by the juncture of two laminate surfaces. As an example, if the top and sides of a counter top are covered with laminate sheets, the laminate sheets may overlap requiring that the overlapping laminate sheet be trimmed flush with the exposed surface of the other laminate sheet to provide a square edge. Likewise the trimming operation can be used to bevel or radius the edge.

The prior art discloses a variety of hand operated tools for carrying out this edge trimming operation. Most conventional routers or trimmers utilize a motor driven blade that is mounted with its longitudinal axis perpendicular to the plane of a flat-surfaced guide plate. For trimming the edge formed by the juncture of two laminate sheets, the guide plate is rested on the surface of the overlapping sheet to support and guide the tool as the cutter is moved perpendicular to the material to be cut. U.S. Pat. Nos. 2,842,173 to Turner et al. and 2,960,126 to DeMan are representative of this type of router. A problem with these types of routers is that they are not effective in areas of limited access, such as in blind corners, because the movement of the tool is limited by the sides of the guide plate and motor interfering with the adjoining walls of the blind corner. Another problem with this type of tool is that, if the guide plate needs to be rested on a curved surface such as the edge of a round table, poor support and guidance is provided for the tool and consequently the workpiece may be marred.

U.S. Pat. Nos. 3,454,061 to Cordone et al. and 3,494,395 to Graham attempt to solve these problems by utilizing a triangular shaped guide plate and a blade offset from the motor. This structure, although an improvement, still does not allow the router to function completely in a blind corner or with a curved guide surface.

Another prior art tool dislcosed in Strakeljahn U.S. Pat. No. 3,893,372 utilizes a pair of guide feet in place of a planar guide plate to provide support and guidance for the cutter. Although this construction functions effectively in blind corners, a relatively long cut must be made without guidance before the guide feet may be utilized. Also, the tool requires a number of adjustments prior to usage.

The present invention is a new and improved tool which overcomes the above shortcomings of the prior art. The tool functions in areas of limited access such as blind corners and can be used effectively if curved or irregularly shaped surfaces are encountered. In addition, beveled or radiused edges may be cut with no adjustments to the tool.

SUMMARY OF THE INVENTION

The power tool of the present invention generally comprises a housing, cutter means supported by the housing and driven by an electric motor for trimming the workpiece, and guide means for slidably engaging and supporting the housing on the workpiece and positioning and guiding the cutter means relative to the workpiece. In the illustrative embodiment of the invention the cutter means comprises a cutter bit which is rotatably mounted on bearings within the housing and driven through a gear train by the motor. The guide means of the invention includes a first guide surface on the housing, substantially parallel to the axis of the cutter bit, and a second guide surface on the housing substantially perpendicular to the cutter bit. The cutter bit is mounted in a recess in the first guide surface with the peripheral surface of its cutting edge approximately flush with, but preferably slightly inset from, the first guide surface. In a first operable position, the first planar guide surface contacts a surface of the workpiece and supports and guides the tool while the cutter trims an overlapping edge of the workpiece. In a second operable position, the second guide surface contacts the surface of the workpiece to support and guide the cutter bit relative to the workpiece. In addition, in the second operable position a cylindrical guide rotatably mounted on the cutter bit contacts a second surface of the workpiece and guides the cutter and limits its axial movement to the plane of the workpiece surface, as the overlapping edge is cut. Differently shaped cutter bits can be used for making straight, beveled or radiused cuts.

Other features of the invention will become more apparent from the following detailed description and accompanying drawing.

DETAILED DESCRIPTION OF THE INVENTION

Figure 1:
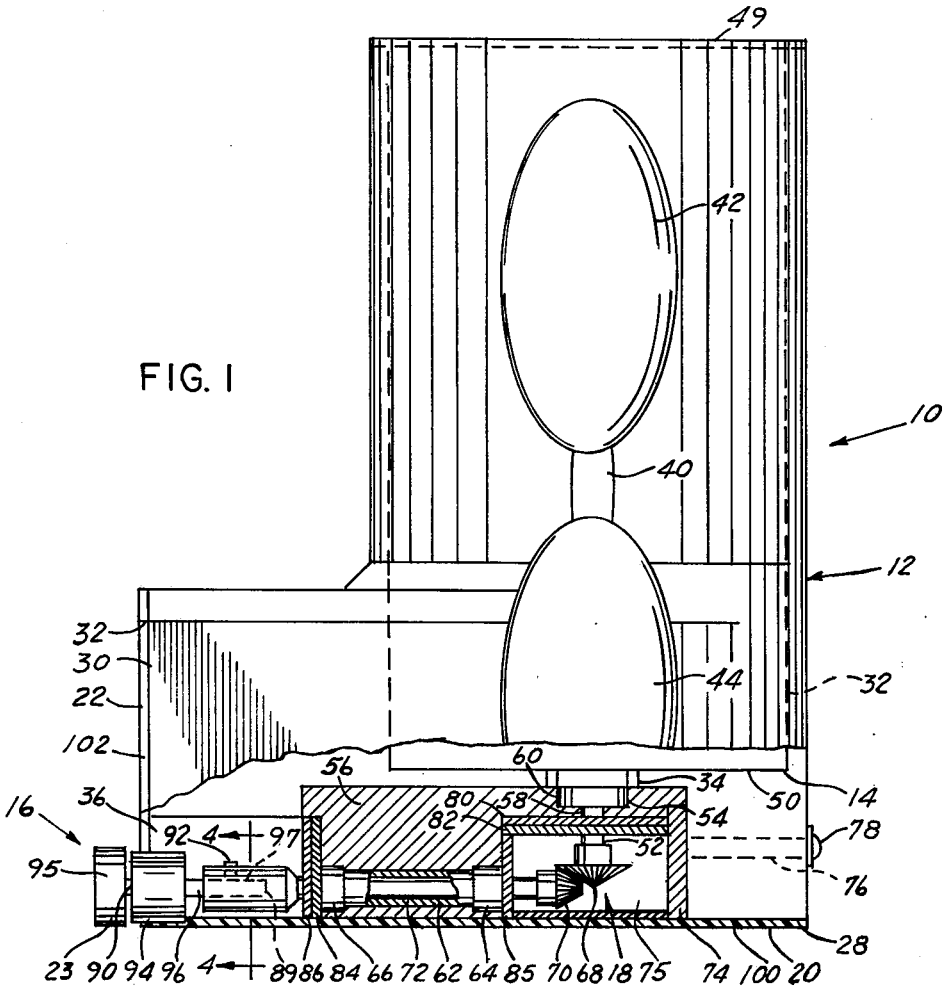
FIG. 1 is a side elevational view partly in cross section of a power tool embodying features of the present invention.
Figure 2:
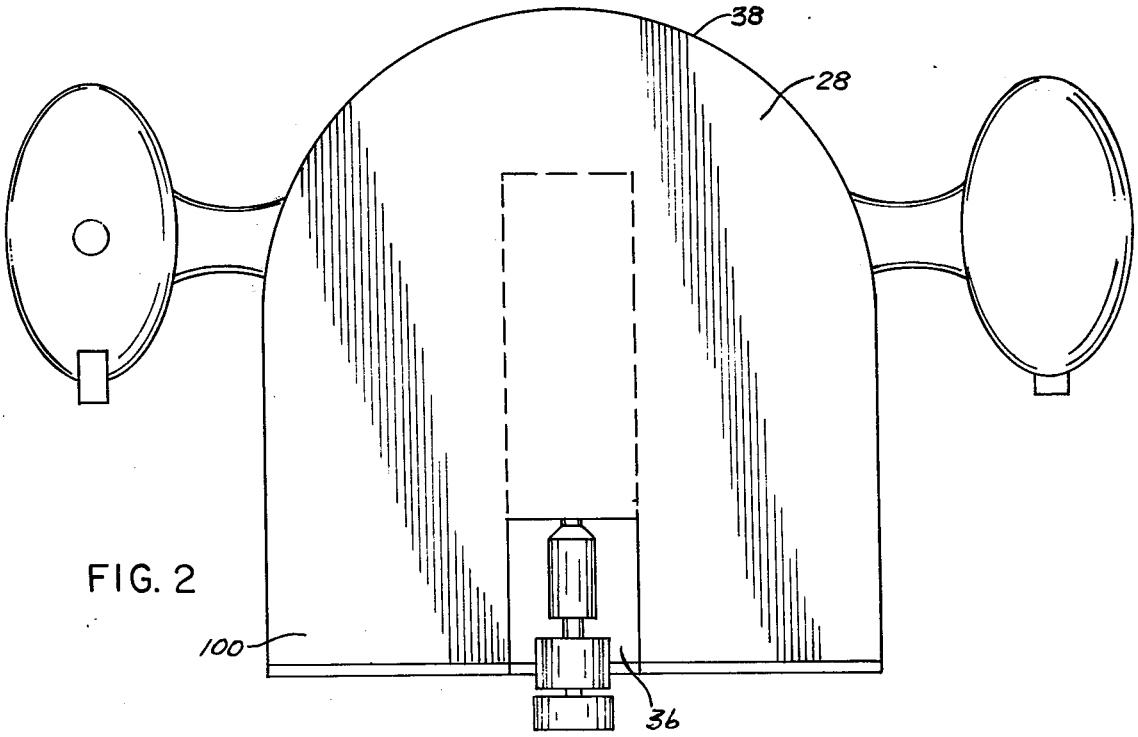
FIG. 2 is a bottom view of the power tool of FIG. 1 with a bottom cover for the crankcase removed.

Referring now to the drawings, a power tool 10 shown in FIGS. 1 and 2 generally comprises a housing 12; an electric motor 14 mounted within the housing; cutter means in the form of a cutter assembly 16 rotatably mounted on bearings within the housing and drivably connected by a drive train 18 to the motor 14; and guide means in the form of a first planar guide surface 20 and a second planar guide surface 22 at right angles to one another and a cylindrical guide surface in the form of a cutter guide bearing 23 freely rotatably mounted on the cutter assembly 16.

Figure 3:
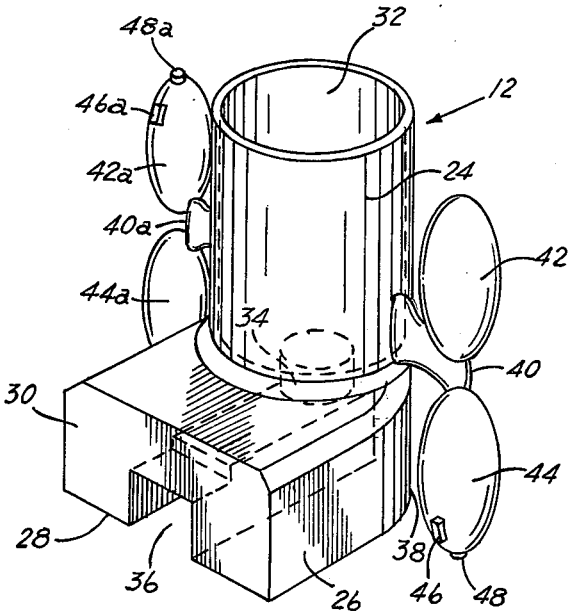
FIG. 3 is a perspective view of the housing of the power tool shown in FIGS. 1 and 2.

Referring now to FIG. 3, the housing 12 shown comprises a one-piece casting which may be fabricated from a lightweight metal such as aluminum. The housing 12 has a generally L-shaped configuration with a hollow cylindrical upper portion 24 and a generally oblong base portion 26. The base portion 26 of the housing is formed with a flat or planar bottom surface 28, as best seen in FIG. 2, and a flat or planar frontal surface 30 which are perpendicular to one another. A circular counterbore 32 extends from the top of the housing part way into the housing for mounting the electric motor 14 therein. Counterbore 32 terminates at another smaller bore 34 which intersects a generally oblong-shaped recess 36 in the base portion 26. Recess 36 has a stepped depth from planar bottom surface 28 and extends from the planar frontal surface 30 of the base along the planar bottom surface 28 nearly to the curved rear surface 38 of the base 26 of the housing 12, as best seen in FIG. 2. Recess 36 is utilized for receiving and containing the cutter assembly 16 and drive train 18 within the housing, as will hereinafter be described.

Two handles 40 and **40*a* are mounted on opposite sides of the housing 12. Handles 40 and 40*a* have generally elliptically shaped upper gripping portions 42 and 42*a*, respectively, and generally elliptically shaped lower gripping portions 44 and 44*a*, respectively, allowing the operator to easily manipulate the tool in different positions. Handle grip portions 42 and 44 then are in alinement with one another along and in spaced relation to one side of the housing, while handle grip portions 42*a* and 44*a* are in alinement with one another along and in spaced relation to the opposite side of the housing, for balanced gripping in operable position 1. Opposed handle grip portions 42 and 42*a* are located approximately midway between the ends of upper portion 24 and opposed handle grip portions 44 and 44*a* are located to the rear of base portion 24 for a balanced gripping in operable position 2. These handles 40 and 40*a*** may be fabricated out of a lightweight strong material such as plastic, and are fixedly secured to the housing by screws or other conventional fasteners.

Each handle 40 and **40*a* has a pair of electric switches 46, 48, and 46*a*, 48*a*, respectively, which are wired to the electric motor 14 for selectively turning the motor on and off. The electrical circuit is connected so that both switches of a pair of switches 46, 48, or 46*a*, 48*a* must be depressed or actuated to complete the circuit and start the motor 14. The switches are arranged such that the operator can simultaneously depress a pair of switches, either switches 46 and 48 or switches 46*a* and 48*a*, with the thumb and fingers while grasping the handles. Switches 46 and 48 are located on lower gripping portion 44 of handle 40 and switches 46*a* and 48*a* are located on upper gripping portion 42*a* of handle 40*a***, permitting the operator to manipulate a pair of switches while holding the tool in different positions.

Referring again to FIG. 1, the power tool is shown completely assembled. The motor 14 is cylindrically shaped and is securely affixed to the housing in counterbore 32 protected by a ventilated cover 49 and supported by surface 50 which is formed by the lower end of the counterbore's intersection with bore 34 of the housing 12. The motor has a drive shaft 52 and an outside bearing 54 which extend through bore 34 of the housing into the recess 36 in the bottom surface 28 of the housing 12. The motor is preferably a commercially available high-speed, 25,000 rpm or greater, 1 horsepower AC electric drive motor.

A bearing block 56, fixedly secured in recess 36 of bottom surface 28 of the housing 12, supports the cutter assembly 16 and gear train 18. The bearing block 56 is a solid block, preferably of metal, having a generally L-shaped configuration and fits into recess 36 of bottom surface 28 with its sidewalls abutting the sidewalls of recess 36 and its lower surface flush with bottom surface 28 of the housing. A first bore 58 through the top of the bearing block 56 permits the motor shaft 52 to extend into recess 36 of the housing. A counterbore 60 concentric with bore 58 on the bearing block provides support for the motor's outer bearing 54. A second bore 62 perpendicular to bore 58 also extends through the bearing block 56. Two bearings 64, 66 are press-fitted into counterbores on either side of bore 62 for supporting a drive shaft 72 of the cutter assembly 16. The diameter of bore 62 is slightly larger than the diameter of the drive shaft 72. Metal retaining plates 85 and 86, fixedly mounted to the bearing block 56, are used to axially retain the movement of the bearings and shaft 72. An oil seal 84 secured by retaining plate 86 seals bore 62 in the bearing block. A second oil seal 80 secured to the bearing block by a metal retainer 82 seals bore 58 on the bearing block.

The gear train 18 for drivably connecting the motor 14 to the cutter assembly 16 comprises a first bevel gear 68 affixed to and rotatably fixedly mounted on the end of the motor shaft 52 in meshing engagement with a second bevel gear 70 rotatably fixedly mounted to one end of the cutter drive shaft 72. The gears 68, 70 are enclosed by a crankcase 74 which is sealingly affixed to the bearing block 56. A space 75 is enclosed by the crankcase 74 and can be filled with oil through an oil fill passage 76 in the housing 12 for providing lubrication to the gears 68, 70 and the bearing 64. In addition holes through the bearing block 56 to bore 62 (not shown) allow oil to flow from space 75 through bore 62 to bearing 66. A removable cap 78 is used to close off and seal the oil fill passage 76.

Figure 4:
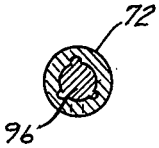
FIG. 4 is a section taken along lines 4—4 of FIG. 1 showing a cross section of the cutter bit shaft.

The cutter assembly 16 comprises a cutter bit 94 having a splined cutter shaft 96 and a generally circular cutting surface or cutting edge. The splined cutter shaft 96 is fixedly rotatably mounted in a splined recess 97 in the enlarged end of the drive shaft 72 with the end of the cutter shaft abutting a bottom abutment surface 89 of the recess 97. A set screw 92 axially retains the cutter bit 94 on the drive shaft 72. FIG. 4 shows a cross section of the cutter shaft 96 mounted in the drive shaft 72. The splined arrangement permits high torque loads to be transmitted through the motor and drive gears to the drive shaft and the cutter bit 94. A circular cutter guide bearing 23 having a bearing shaft 90 is freely rotatably mounted at the end of the cutter bit 94 and may rotate about the longitudinal axis of the cutter bit, independent of the cutter bit 84 and drive shaft 72. The guide bearing 23 has a cylindrical guide surface 95 that helps to guide the cutter bit 94 and limit its movement during operation of the tool, as will hereinafter be explained.

The cutter bit 94 is fabricated from a hard metal such as tool steel and has a circular peripheral cutting edge with a plurality of cutting teeth along ts outer circumferential edge. The outside diameter of the cutter bit 94 is approximately equal to but slightly smaller than the outside diameter of the cutter guide bearing 23. When the cutter bit 94 is mounted in the drive shaft 72 with the cutter shaft 96 abutting bottom abutment surface 89 of the splined recess 97, the guide bearing 23 and part of the cutter bit 84 extend out of recess 36 of the housing past front planar guide surface 22. The circumferential edge of guide bearing 23 is flush with the guide surface 20, and the circumferential edge of cutter bit 94 is slightly higher than guide surface 20.

The cutter assembly 16 is shown to have a shaft 96 that serves as a mounting end portion. The planes of guide surfaces 20 and 22 intersect at a point axially remote from shaft 96 and define an included angle therebetween. The shaft 96 is shown to be located substantially within this included angle and projects axially away from one side of guide surface 22. The cutter assembly 16 further has a leading end portion with the cutting edge 94 projecting axially away from the opposite side of guide surface 22 to precede guide surface 22 in the axial direction. Guide surface 20 is shown to be delimited in the axial direction of the cutter assembly 16 in a direction opposite to the mounting shaft 96 by a plane parallel to and substantially flush with guide surface 22.

The guide means of the power tool shown comprises a first planar guide surface 20 at the bottom of the housing and a second planar guide surface 22 at the front of the housing, together with the cutter guide bearing 23. These guide surfaces 20 and 22 are provided by using relatively thin plastic face plates 100 and 102 which are fixedly mounted to the flat planar surfaces 28 and 30, respectively, on the housing 12. The face plates 100 and 102 are preferably fabricated from a relatively soft plastic laminate material to prevent scratching of the workpiece. The face plates 100 and 102 may be color-coated to a depth of approximately 1/64". The color coating permits wear to be visually determined for replacing the plates when they become worn.

Operation

Figure 7:
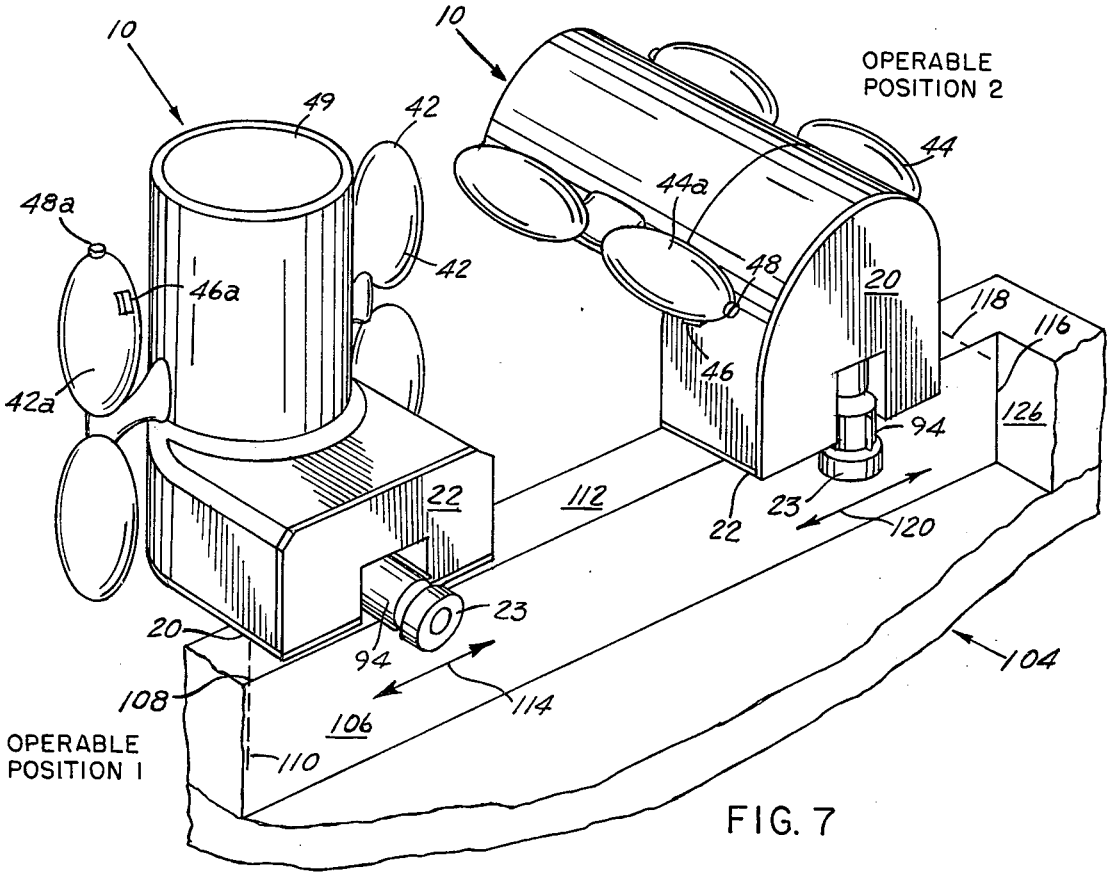
FIG. 7 is a perspective view of the power tool shown in two operable positions finishing an edge portion of a counter top.

Referring to FIG. 7, the power tool 10 is shown in two operable positions for trimming the edges of a counter top 104 having sidewalls 106 and 126 arranged at right angles to one another forming a blind corner 116. In operable position 1, material from sidewall 106 of the counter top 104 projecting past edge 108 formed at the juncture of surfaces 112 and 106 is being trimmed. Dotted line 110 represents the plane of the material in the plane of sidewall 106 which is being trimmed. In position 1 the operator stands behind the tool and preferably grips the upper hand grips 42 and **42*a* and depresses switches 48*a* and 46*a* for operating the motor. Guide surface 20 of the tool is disposed on the flat top surface 112 of the counter, permitting the tool to be moved in either direction, indicated by double arrow 114, for trimming along the edge 108. The large support area provided by guide surface 20 resting on top surface 112 maintains cutting bit 94 in perpendicular alinement with the edge 108** to be trimmed.

The cutter guide bearing 23 is not used in operable position 1. In position 1 the cutter bit 94 is free to move across the entire length of the edge 108 past the blind corner 116. Since the outer peripheral cutting edge of the cutter bit is located approximately flush with but slightly above the lower guide surface 20, the depth of the cut is controlled so that the material on top surface 112 cannot be marred and edge 108 is squarely cut. To trim the same edge, a conventional router having only one guide plate perpendicular to the cutter bit would need to be rested on side surface 106 and could not function near the blind corner 116 because the sides of the guide plate and motor would interfere with surface 126 of the counter edge.

In operable position 2, also shown in FIG. 1, material from top surface 112 projecting past edge 108 is being trimmed. Dotted line 118 represents the plane of the material which is being trimmed. In position 2 the operator stands behind the tool and preferably grips the lower hand grips 44 and **44*a* and depresses switches 46 and 48 for operating the motor. The frontal guide surface 22 of the tool is securely rested on the flat top surface 112 of the counter 104 and the tool may be moved in either direction indicated by the double arrow 120. As in operable position 1**, a large support area is provided for steadying the tool and for holding the cutter bit perpendicular to the material to be trimmed.

In position 2 the cutter guide bearing 23 controls the depth of the cut by rolling along surface 106 of the counter top, acting as a guide, and preventing the cutter bit from cutting axially inward into the plane of surface 106 and marring the material. "Axially inward" means that the axis of the cutter bit is moved in a direction parallel to its axis of rotation and the guide bearing 23 therefore limits the movement of the cutter bit from passing into the plane of surface 106. Because the outside diameter of the guide bearing is approximately the same as the diameter of the cutter bit 84, however, the bit trims the edge 108 approximately flush with the plane of surface 106. Once again the cutter bit 94 is free to traverse the entire length of the edge 108 for trimming the edge.

Figure 8:
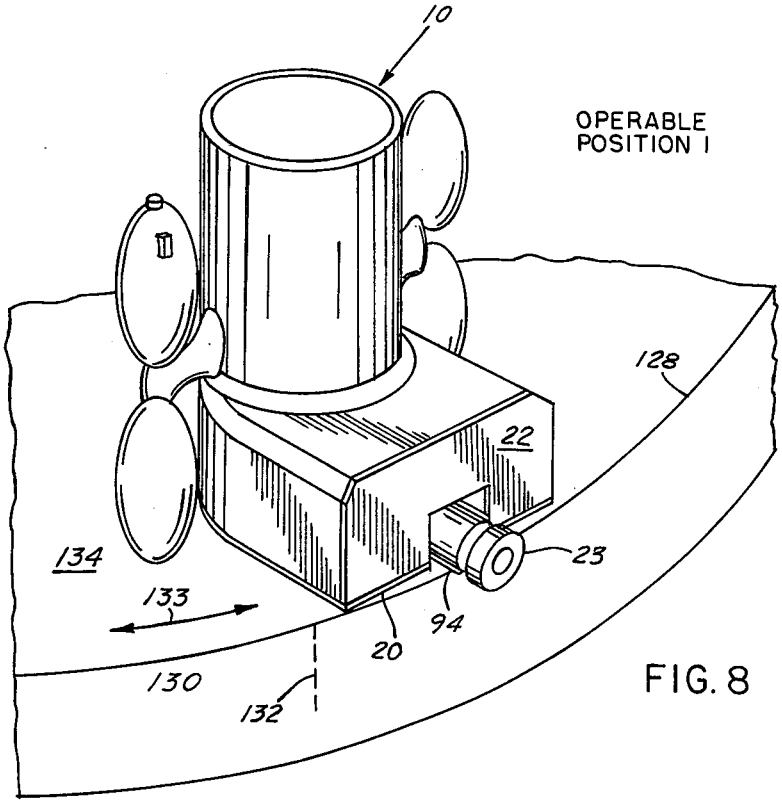
FIG. 8 is a perspective view of the power tool shown in operable position 1 finishing an edge portion of a round table.

In FIG. 8 the tool 10 is shown in operable position 1 trimming the circumferential edge 128 of a flat-top round table. The material being trimmed projects upward from cylindrical surface 130 of the table represented by dotted line 132. In position 1 the guide surface 20 of the tool is disposed on the flat top surface 134 of the table, maintaining the cutter in position with respect to the material to be trimmed. To trim the same edge as the machine is moved across the edge, as indicated by double arrow 133, a conventional router having only one guide plate perpendicular to the cutter would need to be rested on surface 130, which because of the curvature of the surface would provide poor support and guidance for the cutter. As previously stated, in operable position 1, since the outer peripheral edge of the cutter bit 84 is located approximately flush with the lower guide surface 20, the depth of the cut is controlled so that surface 134 is not marred but edge 128 is squarely cut.

Figure 9:
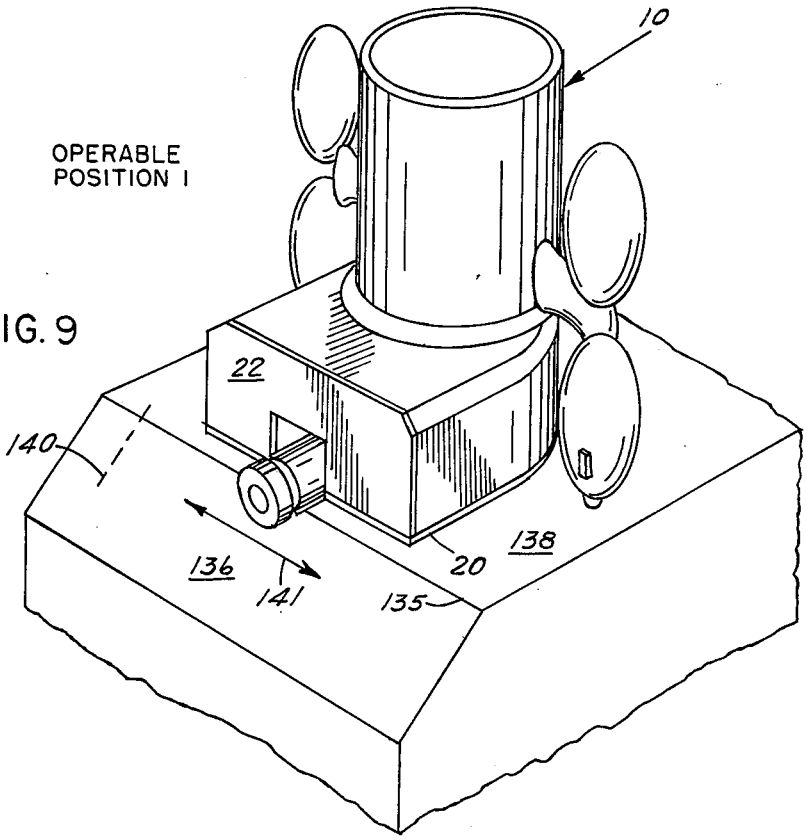
FIG. 9 is a perspective view of the power tool shown in operable position 1 finishing an edge between two angled surfaces.

In FIG. 9 the tool 10 is shown in operable position 1 trimming the edge 135 formed between two angled surfaces 136 and 138. The material being trimmed projects outwardly from the plane of surface 136 and is represented by dotted line 140. To trim this edge 135 the lower guide surface 20 is disposed or rested on flat planar surface 138 and the machine is moved in the direction indicated by double arrow 141 cutting the overlapping of surface 136 flush with surface 138. Again, because of the arrangement of the guide plate with respect to the cutter on the conventional router, this would be a difficult edge to trim.

There are many other applications where the present tool, because of the two perpendicular or substantially perpendicular guide surfaces and the cutter arrangement in a particular relation thereto, would function more effectively than conventional routers. On a flat, thin-edge cabinet door, for instance, the tool could use the flat planar surface of the door for guidance and have a solid support area, rather than the narrow side surfaces which a conventional router would follow. Another application for the present tool is trimming the edges perpendicular to two different surfaces, as might be encountered on a table having two parallel surfaces separated by a vertical step. In this situation both perpendicular guide surfaces of the tool could be used simultaneously.

In addition to performing all of these applications satisfactorily, the tool is also able to bevel cut or radius an edge without the adjustments to the tool that are required with a conventional router. To cut a beveled or curved edge with a conventional router the height of the guide plate with respect to the cutter must be accurately adjusted. With the power tool of the present invention the cutter bit shaft is of a predetermined length X shown in FIGS. 5 and 6. The dimension X is such that, when the cutter bit is inserted into recess 97 of the drive shaft with the end of the bit abutting bottom abutment surface 89 of the recess 97, proper axial alinement is established between the cutting surface and the guide surface 22 of the tool to make the cut. No further adjustments to the tool are needed to make the beveled or curved edge.

Figure 5:
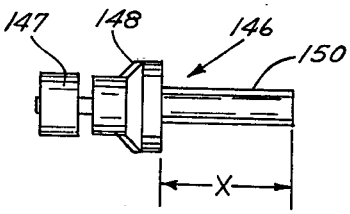
FIG. 5 is a side elevational view of a 45° bevel bit cutter.
Figure 6:
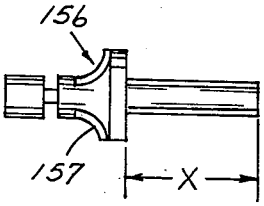
FIG. 6 is a side elevational view of a curved finish bit cutter.

A bevel cutter bit 146 shown in FIG. 5 is used for cutting beveled edges. Bevel cutter bit 146 has a generally conical cutter surface or peripheral edge 148 with the cutter blades located along the periphery of the conical surface. As with the standard cutter bit 94, the guide bearing 147 of bevel cutter bit 146 is slightly larger than the small diameter of the conical cutting surface. Like the standard cutter bit 94, the shaft 150 of this bevel cutter 146 also has a splined cross section and the length of the shaft is of the predetermined dimension X.

For making a bevel cut, bevel cutter bit 146 is secured in the drive shaft 72 of the tool in place of the conventional cutter bit 94, and the tool is operated only in operable position 2, as shown in FIG. 7. The predetermined length X of the cutter shaft 150 of the bevel cutter bit 147 insures that the cutting surface 148 is in proper axial position with respect to the guide surface 102, and no adjustments are required on the tool to make the bevel cut as with a conventional cutter.

A curved cutter bit 156 is shown for making radiused edges utilizing operable position 2 of the tool. This cutter bit has a curved cutting edge 157 and is also formed with a predetermined shaft length X. As with the bevel cutter 146, because of shaft length X no adjustments to the machine are required to make the radius cut.

From the foregoing it is apparent that the novel arrangement of two perpendicular guide surfaces, a cutter in a particular disposition relative thereto, and a cutter guide bearing allow the tool to be used in two different positions for edge trimming. In operable position 1 the flat guide surface 20 parallel to the cutting edge of the cutter bit 94 and the location of the cutter edge with respect to the guide surface 20 insure that the edge will be cut squarely with no marring of the support surface. In operable position 2 frontal guide surface 22 perpendicular to the axis of the cutting blade and cutter guide bearing 23 cooperate to support and guide the tool with no marring of the overlapping surface. For bevel or radius cutting the tool can be used in operable position 2 with shaped bits. The dimensioning of the length of the bit shaft and abutment surface 89 of the bit mounting recess 97 insure the proper axial alinement of the cutting surface with respect to guide surface 22, and no further adjustments to the machine are needed to make the bevel or radiused cut.

Although the present invention has been described with a certain degree of particularity, it is understood that the present disclosure has been made by way of example and that changes in details of structure may be made without departing from the spirit thereof.

What is claimed is:

1. A power tool comprising:

cutter means driven by a motor for rotation about an axis for cutting a workpiece; and guide means including a first guide surface arranged substantially parallel to the axis of said cutter means and approximately flush with the outer peripheral surface of said cutter means for supporting and guiding said cutter means relative to a first surface of the workpiece in a first operable position, a second guide surface arranged substantially perpendicular to the axis of the cutter means for supporting and guiding said cutter means relative to said first surface of the workpiece in a second operable position, said cutter means having a mounting end portion, the planes of said first and second guide surfaces intersecting at a point axially remote from said mounting end portion and defining an included angle therebetween, said mounting end portion being located substantially within said included angle, said mounting end portion projecting axially away from one side of said second guide surface, said cutter means further having a leading end portion having said cutting edge and projecting axially away from the opposite side of said second guide surface to precede said second guide surface in said axial direction, said first guide surface being delimited in the axial direction of said cutter means in a direction opposite to said mounting end portion of said cutter means by a plane substantially parallel to and substantially flush with said second guide surface, and a cylindrical guide surface mounted at one end of said cutter means remote from said second guide surface and having an outside diameter approximately equal to the diameter of the outer peripheral cutting edge of said cutter means for contacting a second surface of the workpiece for guiding the cutter means and limiting the movement of the cutter means from passing into the plane of the second surface of the workpiece in said second operable position.

2. A power tool comprising:

cutter means adapted to be driven by a motor for rotation about an axis for cutting a workpiece, said cutter means having an outer peripheral cutting edge concentric with said axis; and guide means including a first guide surface arranged substantially parallel to the axis of said cutter means and substantially flush with the outer peripheral surface of said cutter means, and a second guide surface arranged substantially perpendicular to the axis of rotation of the cutter means, said cutter means extending through an opening in said second guide surface, said cutter means having a mounting end portion, the planes of said first and second guide surfaces intersecting at a point axially remote from said mounting end portion and defining an included angle therebetween, said mounting end portion being located substantially within said included angle, said mounting end portion projecting axially away from one side of said second guide surface, said cutter means further having a leading end portion having said cutting edge and projecting axially away from the opposite side of said second guide surface to precede said second guide surface in said axial direction, said first guide surface being delimited in the axial direction of said cutter means in a direction opposite to said mounting end portion of said cutter means by a plane substantially parallel to and substantially flush with said second guide surface.

3. A power tool as recited in claim 2 including a housing supporting said cutter means and wherein the first guide surface and the second guide surface are flat surfaces on the exterior of said housing at substantially right angles to one another at a corner of said housing.

4. A power tool as recited in claim 3 wherein said cutter means is a circular cutter bit mounted on bearings in the housing in a recess in the first guide surface with the outside diameter of the cutter bit approximately flush with the first guide surface.

5. A power tool as recited in claim 4 wherein the cylindrical guide surface comprises a roller bearing having an outside diameter approximately equal to the outside diameter of the cutter bit, mounted on an end of the cutter bit, for rotation about the axis of the cutter bit.

6. A hand operated power tool for trimming and finishing an edge portion of a workpiece formed by the juncture of two surfaces of the workpiece, comprising:

a housing;

a motor mounted to said housing;

cutter means mounted to the housing for rotation about an axis by said motor for cutting a workpiece, said cutter means having an outer peripheral cutting edge concentric with said axis; and guide means on said housing including a substantially planar first guide surface having a recess therein receiving said cutter means, said first guide surface being arranged substantially parallel to said axis and approximately flush with an outer peripheral cutting edge of said cutter means for supporting said housing on a first surface of a workpiece and guiding said cutter means relative to said workpiece in a first operable position, said cutting edge being slightly inset from said first guide surface, and a substantially planar second guide surface arranged substantially perpendicular to the axis of the cutter means for supporting said housing on said first surface of the workpiece and guiding said cutter means relative to said workpiece in a second operable position, said cutter means having a mounting end portion, the planes of said first and second guide surfaces intersecting at a point axially remote from said mounting end portion and defining an included angle therebetween, said mounting end portion being located substantially within said included angle, said mounting end portion projecting axially away from one side of said second guide surface, said cutter means further having a leading end portion having said cutting edge and projecting axially away from the opposite side of said second guide surface to precede said second guide surface in said axial direction, said first guide surface being delimited in the axial direction of said cutter means in a direction opposite to said mounting end portion of said cutter means by a plane substantially parallel to and substantially flush with said second guide surface.

7. A power tool as set forth in claim 6 wherein said cutter means projects from said housing substantially beyond said second planar guide surface.

8. A power tool for trimming and edge-finishing a laminated workpiece and the like comprising:

a housing having a first guide surface for supporting and guiding the housing for movement over a first surface of the workpiece in a first operable position, and a second guide surface substantially perpendicular to the first guide surface for supporting and guiding the housing for movement over said first surface of the workpiece in a second operable position turned at right angles to said first operable position;

a motor mounted to said housing;

a cutter bit having a cutting edge, said cutter bit mounted in a recess in the first guide surface of said housing for rotation about an axis by the motor, said cutting edge located in a plane approximately flush with the plane of said first guide surface; and a guide roller having a cylindrical guide surface and mounted to an end of the cutter bit for contacting a second surface of the workpiece in said second operable position for guiding the cutter bit and limiting the axial movement of the cutter bit to the plane of the second surface of the workpiece.

9. A power tool as defined in claim 8 wherein said cutter bit is mounted on bearings within said recess and is drivingly connected to said motor by a gear train.

10. A power tool as defined in claim 8 wherein said housing is a unitary metal body and has a plastic face plate attached to each of said guide surfaces.

11. The laminate cutter as defined in claim 8 wherein the housing has two handles attached on either side and each handle has a first gripping portion and a second gripping portion in alinement with one another along one side of the housing.

12. A unitary cast housing for use in combination with an electric drive motor and a cutter bit having a cutting edge, to provide a power tool, comprising:

a body formed with a first planar guide surface and a second planar guide surface disposed at right angles to one another for contacting a workpiece and supporting and guiding said body for sliding movement over a workpiece;

a bore within the housing for slidably receiving and containing an electric motor; and a recess in the first planar guide surface for receiving and containing a cutter bit for rotation by said motor about an axis parallel to the first planar guide surface, with the outer peripheral edge of the cutter surface approximately flush with the first planar guide surface, said cutter bit having a mounting end portion, the planes of said first and second planar guide surfaces intersecting at a point axially remote from said mounting end portion and defining an included angle therebetween, said mounting end portion being located substantially within said included angle, said mounting end portion projecting axially away from one side of said second guide surface, said cutter bit further having a leading end portion having said cutting edge and projecting axially away from the opposite side of said second planar guide surface to be in front of said second planar guide surface in said axial direction, said first planar guide surface being delimited in the axial direction of said cutter bit in a direction opposite to said mounting end portion of said cutter means by a plane substantially parallel to and substantially flush with said second planar guide surface.

13. A unitary cast housing as defined in claim 12 and further including a pair of handles on opposite sides of said body.

14. A unitary cast housing as defined in claim 13 wherein each handle has a first gripping portion and a second gripping portion and a pair of electric switches to selectively activate a motor.

15. A cutter assembly for use with an electric power tool having a drive motor and a planar guide surface for supporting and guiding the tool, especially adapted for bevel or radius cutting an edge portion of a workpiece formed by the juncture of two surfaces of the workpiece, comprising:

a drive shaft mounted for rotation by a motor about an axis substantially perpendicular to the planar guide surface and having an end spaced a predetermined distance from the planar guide surface;

a blind recess of a predetermined depth in the end of the drive shaft having a bottom abutment surface;

a cutter bit having an axis, a cutting edge, and a cutter shaft of a predetermined axial length for rotatably mounting the cutter bit in the blind recess of said drive shaft with the end of the bit shaft abutting the bottom abutment surface of the blind recess, whereby an axial spacing is established between the guide surface and cutting surface of the cutter bit for making a bevel or radius cut; and a roller guide freely rotatably mounted at one end of the cutter bit for rotation about the axis of the cutter bit for guiding the tool over a guide surface of the workpiece and for limiting the movement of the cutter bit from passing into the plane of the guide surface.

16. The cutter assembly as defined in claim 15 wherein the bit shaft and blind recess of the drive shaft have a splined cross section.

17. The cutter assembly as defined in claim 15 wherein the cutting surface of the cutter bit is conically shaped for bevel trimming the edge portions of the workpiece.

18. The cutter assembly as defined in claim 15 wherein the cutting surface of the cutter bit is curved for radius trimming the edge portions of the workpiece.

* * * * *